US011376614B2

(12) United States Patent
Hofman

(10) Patent No.: US 11,376,614 B2
(45) Date of Patent: Jul. 5, 2022

(54) SHOWERHEAD ASSEMBLY WITH SEQUENTIALLY PULSING NOZZLE SETS

(71) Applicant: ETL, LLC, Reno, NV (US)

(72) Inventor: David Hofman, Reno, NV (US)

(73) Assignee: ETL, LLC, Reno, NV (US)

( * ) Notice: Subject to any disclaimer, the term of this patent is extended or adjusted under 35 U.S.C. 154(b) by 0 days.

(21) Appl. No.: 17/061,178

(22) Filed: Oct. 1, 2020

(65) Prior Publication Data

US 2022/0105526 A1 Apr. 7, 2022

(51) Int. Cl.
*B05B 3/04* (2006.01)

(52) U.S. Cl.
CPC ..... *B05B 3/04* (2013.01)

(58) Field of Classification Search
CPC ..... B05B 3/04; B05B 1/18; B05B 1/185
See application file for complete search history.

(56) References Cited

U.S. PATENT DOCUMENTS 4,190,207 A * 2/1980 Fienhold ..... B05B 1/18 239/447
4,239,409 A * 12/1980 Osrow ..... B05B 3/04 401/281
4,588,130 A 5/1986 Trenary et al.
5,215,258 A 6/1993 Jursich
5,433,384 A 7/1995 Chan et al.
5,476,225 A 12/1995 Chan
5,704,547 A 1/1998 Golan et al.
5,862,985 A * 1/1999 Neibrook ..... B05B 3/04 239/99
6,360,967 B1 3/2002 Schorn
D515,661 S 2/2006 Hughes et al.
7,770,820 B2 8/2010 Clearman et al.
D649,623 S 11/2011 Flowers
D669,962 S 10/2012 Schoenherr et al.
D694,357 S 11/2013 Brodey et al.
D710,973 S 8/2014 Madsen
8,794,543 B2 8/2014 Leber
9,067,222 B2 * 6/2015 Gransow ..... B05B 1/12
9,895,701 B2 2/2018 Tian et al.
2013/0199641 A1 * 8/2013 Zhou ..... B05B 1/3006 137/624.27

* cited by examiner

*Primary Examiner* — Steven M Cernoch
(74) *Attorney, Agent, or Firm* — David Duckworth

(57) ABSTRACT

A showerhead assembly is provided which includes an outer housing and inner housing. The inner housing includes a support disk and gear housing disk having two diverter arms and a gear train. The gear train includes a propeller, a coaxial pinion, and a large gear. The outer housing includes the base and a faceplate having nozzle systems connecting to complementary orifices. Water enters the internal housing via a channel where it is further diverted by the diverter arms so as to impinge on the gear train's propeller, causing the gear train's individual components to rotate. Upon the rotation of the large gear, the large gear's slot aligns with a selected orifice whereby water travels through and enters a corresponding nozzle system. This sequence continues, causing water to sequentially spray from individual nozzles in systematic intervals so as to create a strobe-like spray pattern.

2 Claims, 5 Drawing Sheets

SHOWERHEAD ASSEMBLY WITH SEQUENTIALLY PULSING NOZZLE SETS

BACKGROUND OF THE INVENTION

The present invention relates to showerheads. More particularly, the present invention relates to showerheads having multiple nozzle sets that release water at varying intervals so as to produce a pulsing effect on the emitted water.

Showerheads are commercially available in numerous designs and configurations for use in showers, faucets, spas, sprinklers and other personal and industrial systems. The vast majority of showerheads include spray heads which may be categorized as being either stationary or oscillating and have either fixed or adjustable openings. Stationary spray heads with fixed jets are the simplest constructions consisting essentially of a central conduit connected to one or more spray nozzles directed to produce a constant pattern. The stationary spray showerheads cause water to flow through the construction to contact essentially the same points on a user's body in a repetitive fashion.

Multifunction showerheads are able to deliver water in many different spray patterns such as a fine spray, a coarse spray, or a pulsating spray. Of course, many other spray patterns may also be provided.

Moreover, many showerhead assemblies allow users to manipulate spray nozzles into various positions and alignments so as to assist in the cleaning process. Advantageously, some showerhead assemblies include spray nozzles having control mechanisms that allow the user to manipulate water flow so as to choose a desired spray pattern. For example, U.S. Pat. No. 5,433,384 discloses a handheld showerhead that produces a pulsating spray pattern by way of a push button attached to a pawl bearing against a ratchet wheel. Further, this showerhead includes a rotating turbine having a flange and openings, wherein rotation of the turbine causes the openings to align with conduits so as to cause nozzles to periodically pulse water. However, this construction requires user intervention and a push-button mechanism in order to yield a pulsating spray pattern.

Additionally, U.S. Pat. No. 4,588,130 describes a showerhead that produces a pulsating spray pattern by way of three different passageways and a vaned rotating member having a partial plate and an open side. Specifically, as the plate rotates, it aligns with and selectively blocks a given conduit. Meanwhile, the rotating member's opening is exposed to nozzle outlets, whereby water passes from the openings through the outlets in order to produce a water in a pulsating fashion. However, this reference discloses a showerhead assembly having only one showerhead housing.

Similarly, U.S. Pat. No. 5,215,258 discloses a showerhead having a rotating mechanism that produces a pulsating spray pattern. Importantly, this showerhead housing includes a gear system having a rotor integrated into a dial so as allow rotation as a unit when the gear system is impinged by water.

Though these references both describe a showerhead which provide a housing system having a rotating mechanism and pulsing capability, neither specify a particular mechanism having an outer housing and inner housing with the necessary gear train assembly, including but not limited to the inclusion of diverter arms, that would produce a strobe effect on the emitted water. Additionally, none of these references describe a gear mechanism that operates as a unit with a set of nozzle conduits and nozzle outlets designed to release water in sequenced intervals so as to produce a strobe-effect.

Thus, it would further be advantageous to provide a showerhead assembly that included a primary showerhead having two housings functioning as a unit in order to release water in periodic, patterned intervals so as to create a strobe spray pattern.

Further, it would be advantageous to provide a showerhead assembly that included a plurality of nozzle conduits and a corresponding number of nozzle outlet sets that are selectively blocked and unblocked by the inner housing mechanism, thereby releasing water in a rhythmic fashion without user intervention so as to enable the user to create a unique shower experience.

SUMMARY OF THE INVENTION

Briefly, in accordance with the invention, an improved water spraying assembly is provided which includes an outer housing and inner housing working as constituent parts. The inner housing includes two disks: a support disk and a gear housing disk. Further, the inner housing comprises an internal housing structure bearing a gear train assembly. Additionally, the outer housing includes the showerhead housing base, wherein the inner housing resides, and a circular showerhead faceplate, constituting the outermost portion of the showerhead assembly, thereby covering the inner housing portions. Specifically, the showerhead faceplate includes a plurality of nozzle systems wherein each nozzle system includes a duct formed into the faceplate's backside which extends to one or more nozzles which project through the faceplate to the faceplate's front side. The water spraying assembly has particular application for use within a showerhead. Accordingly, the preferred water spraying assembly is described as a showerhead assembly.

The primary showerhead can be relatively traditional in construction including a showerhead housing base connected to a water source by a neck portion. Additionally, the neck portion includes a conduit having an inlet threadably affixed to a water source pipe. The inlet is in fluid connection with the pipe so as to receive water from it and allow such water to travel through showerhead housing base into the nozzle systems for ejection. Various showerhead housing bases and conduit constructions can be determined by those skilled in the art.

Preferably, the showerhead housing base is frustoconical in shape. The support disk, which forms the inner layer of the showerhead's inner housing side, is affixed to and secured onto the gear housing disk whereby it forms its support cover. Further, the gear housing disk is directly adjacent to and works in conjunction with the outer housing's showerhead faceplate.

The anterior of the gear housing disk, which is the side of the disk affixed to the support disk, includes an internal housing structure with a gear train. Specifically, the nucleus of the gear housing disk's inner layer is concaved so as to house the internal housing structure bearing the gear train. In the preferred embodiment, the internal housing is cuboid shaped. The internal housing structure includes a water channel, two diverter arms, and a gear train. Additionally, the posterior of the gear housing disk, which is the side attached to the showerhead faceplate, includes a plurality of similarly shaped window slits. In a preferred embodiment, the gear housing disk includes four window slits that are trapezoidal in shape.

In the preferred embodiment, the conduit's inlet collects water from the water source and empties such water into the internal housing structure's water channel that is in fluid connection with the gear train. Specifically, the water channel includes a first end that is in fluid connection with the conduit's inlet and a second end that is in fluid connection with the gear train. The gear train includes three-wheel portions: a propeller, pinion, and large gear. More specifically, the water received by the water channel flows through the propeller portion of the gear train, whereby such water flow causes the propeller to rotate in a counterclockwise direction. The propeller, which is directly below and coupled with the pinion, continues to rotate as water passes through, thereby causing the pinion to rotate in a clockwise direction. Additionally, the pinion, which is meshed with the large gear, causes the large gear to revolve in a clockwise direction as water flows from the rotating pinion portion and passes through the large gear.

Importantly, two diverter arms are positioned to divert water and are located adjacent to the propeller teeth, thereby functioning as a driving force to propel water through the gear train. Specifically, the first diverter arm projects from the internal housing structure and is directly adjacent to the second end of the water channel and left of the propeller so as to direct the water flow through the internal housing structure. Additionally, the second diverter arm project from the internal housing structure and resides beneath the large gear, bordering the propeller's right side. This second diverter arm directs water from the propeller to one side of the large gear.

Further, the large gear includes one slot similarly shaped and sized to the gear housing disk's window orifices. Upon rotation of the large gear, the large gear's slot aligns with one of the window slits so as to create an open passageway by which water flows through. The showerhead faceplate comprises nozzle systems including nozzle ducts having nozzle outlet sets. Additionally, the nozzle systems are positioned so as to be in alignment with the gear housing disk's window orifices. The showerhead faceplate remains static in position as the gear housing disk's gear train revolves in response to water flowing through its internal housing structure. Accordingly, as water travels from the large gear's slot and through the window orifice to which it aligns with, such water then exits from the window orifice into a complementary nozzle system. Water continues to flow through the nozzle system's duct and is emitted through the nozzle's respective nozzle outlet set in intervals. Water continues to sequentially be released from the outlets as such water flows continuously impinges the gear train and passes through the internal housing structure, ultimately exiting through alternating nozzle outlet sets. Specifically, and as a consequence of the water selectively exiting through varying nozzle outlet sets, the user experiences a strobe-like water spray pattern.

Thus, it is an object of the present invention to provide a spray head assembly having an improved nozzle strobe spray pattern capability compared to previous showerheads.

Furthermore, it is an additional object of the present invention to provide a spray head assembly having an improved construct so as to generate a strobe effect on the spray pattern without relying on user intervention and instead depending on two housing structures working in conjunction with each other.

Other features and advantages of the present invention will be appreciated by those skilled in the art upon reading the detailed description which follows with reference to the Drawings.

BRIEF DESCRIPTION OF THE DRAWINGS

These and other, further and more specific objects and advantages of the invention will be apparent to those skilled in the art from the following detailed description thereof, taken in conjunction with the Drawings, in which.

DETAILED DESCRIPTION OF THE INVENTION

Figure 1:
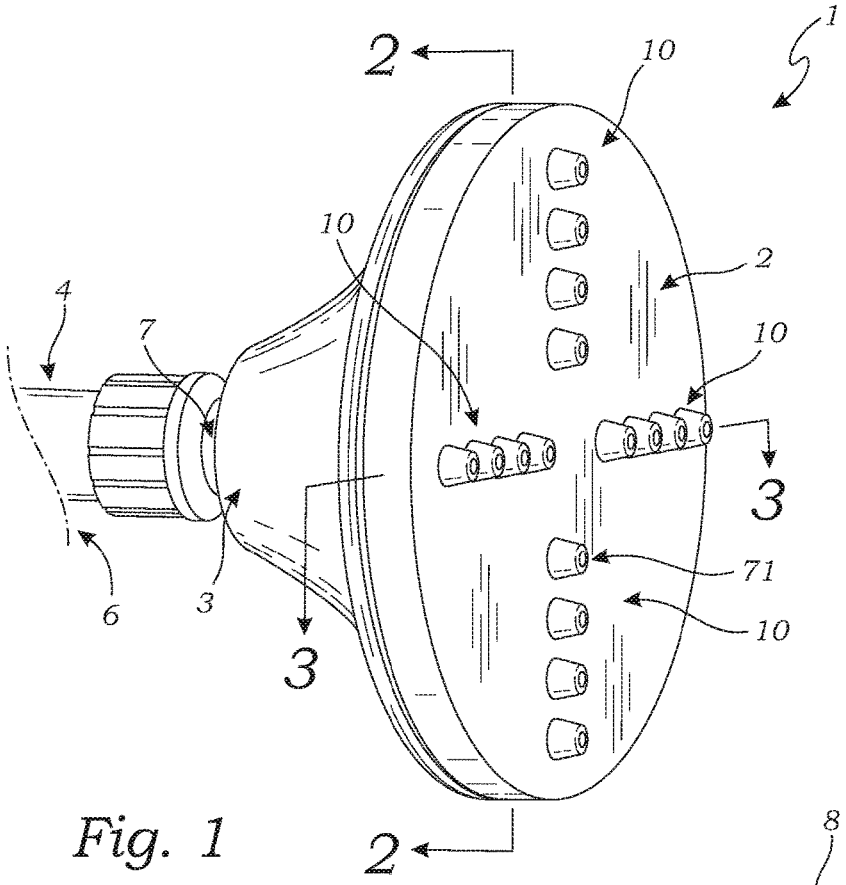
FIG. 1 is a left perspective view of the showerhead assembly wherein the showerhead faceplate includes four nozzle outlet sets.
Figure 2:
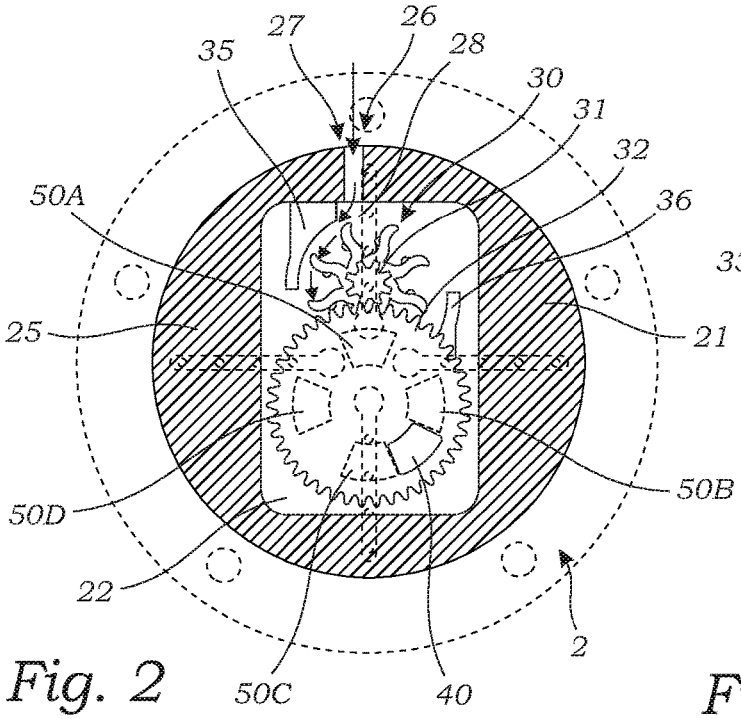
FIG. 2 is a front cutaway view of the showerhead assembly illustrated in FIG. 1 wherein the showerhead faceplate superimposes the gear housing disk, illustrating the flow of water entering the water channel and impinging on the gear train's propeller.
Figure 3:
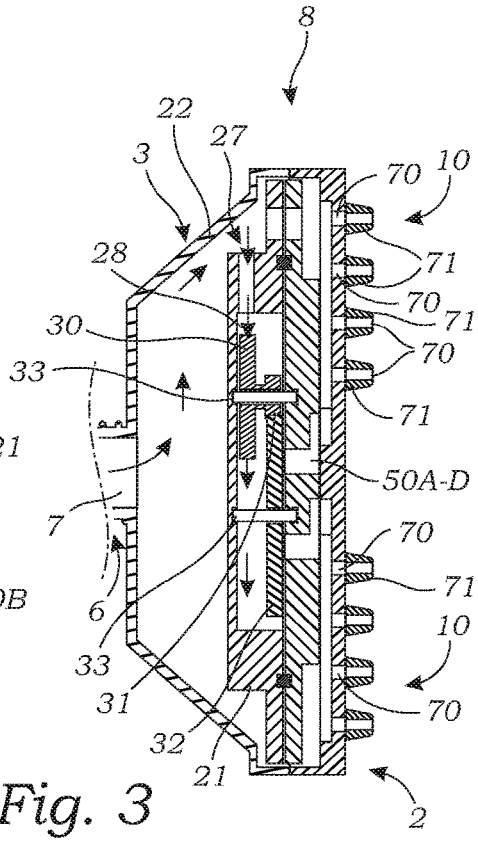
FIG. 3 is a left cutaway view of the showerhead assembly illustrated in FIG. 1 illustrating the flow of water from the conduit through the gear train assembly, wherein the gear slot is not aligned with a window orifice, thereby preventing water from passing through a nozzle system.
Figure 4:
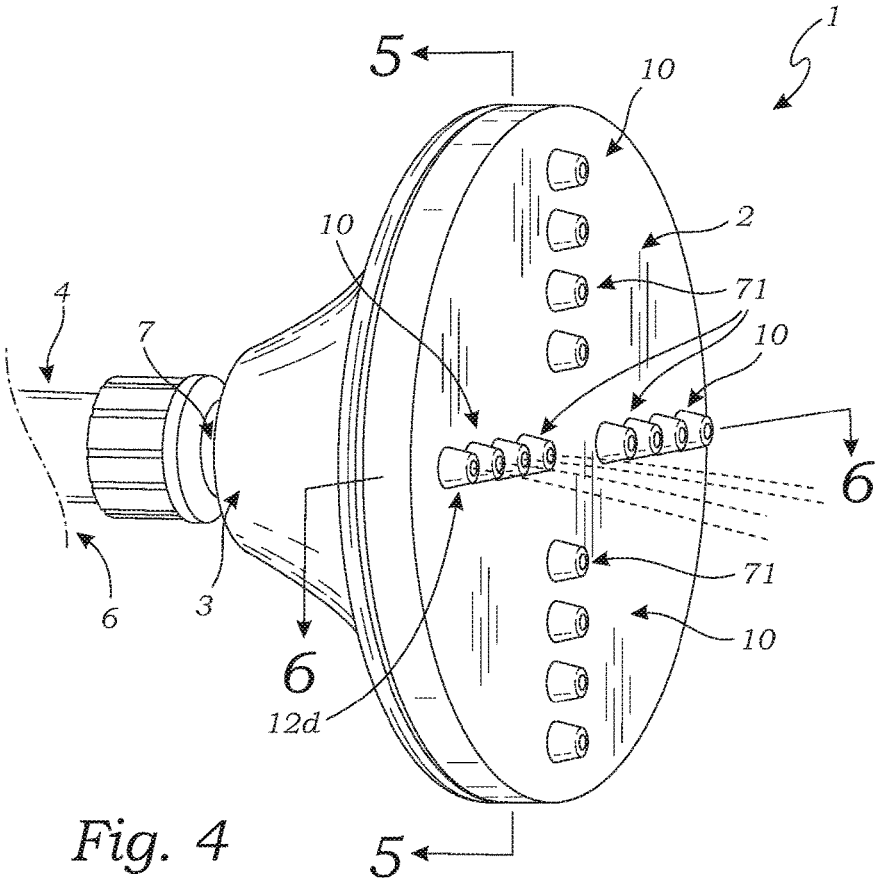
FIG. 4 is a left perspective view of the showerhead assembly illustrated in FIG. 1 wherein one of the four nozzle outlet sets is expelling water.
Figure 5:
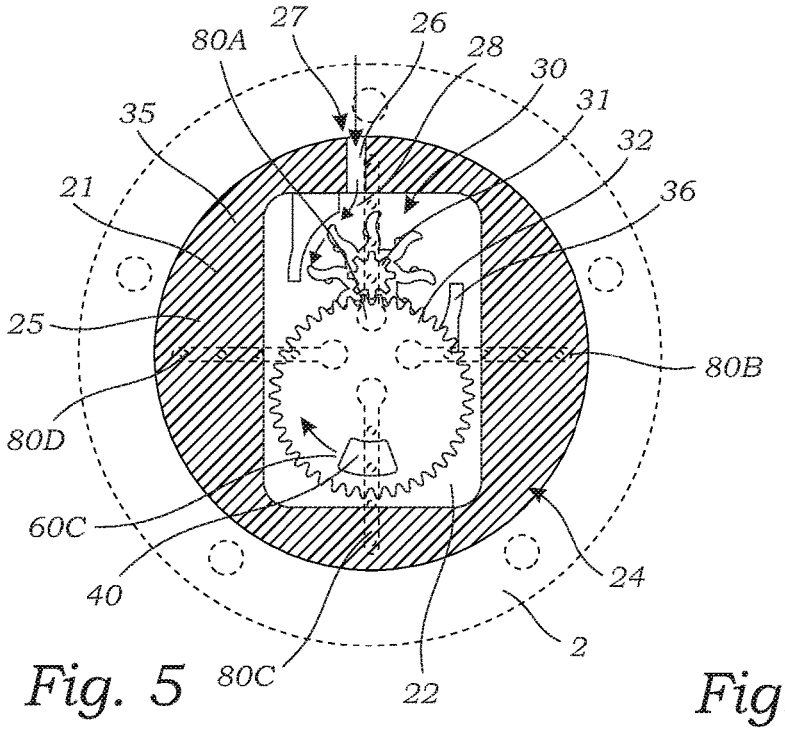
FIG. 5 is a front cutaway view of the showerhead assembly illustrated in FIG. 1 illustrating the large gear rotating, thereby causing the large gear's slot to align with the window orifice overlapping the bottom nozzle system.
Figure 6:
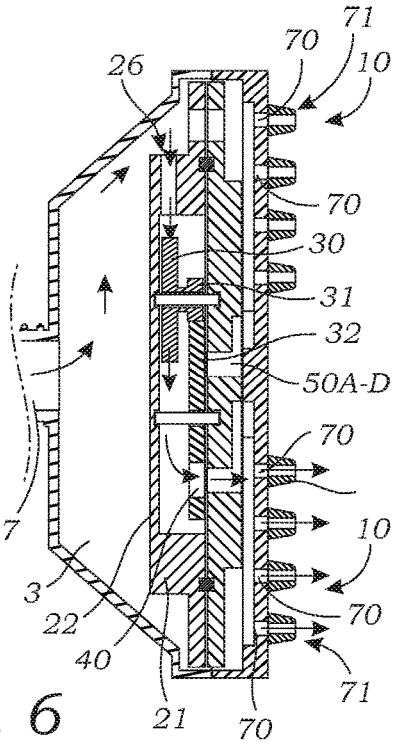
FIG. 6 is a left cutaway view of the showerhead assembly illustrated in FIG. 1 illustrating the flow of water from the conduit through the gear train assembly, wherein the gear slot is aligned with a window orifice, thereby allowing water to pass through the nozzle system and eject out of its respective nozzle outlet.
Figure 7:
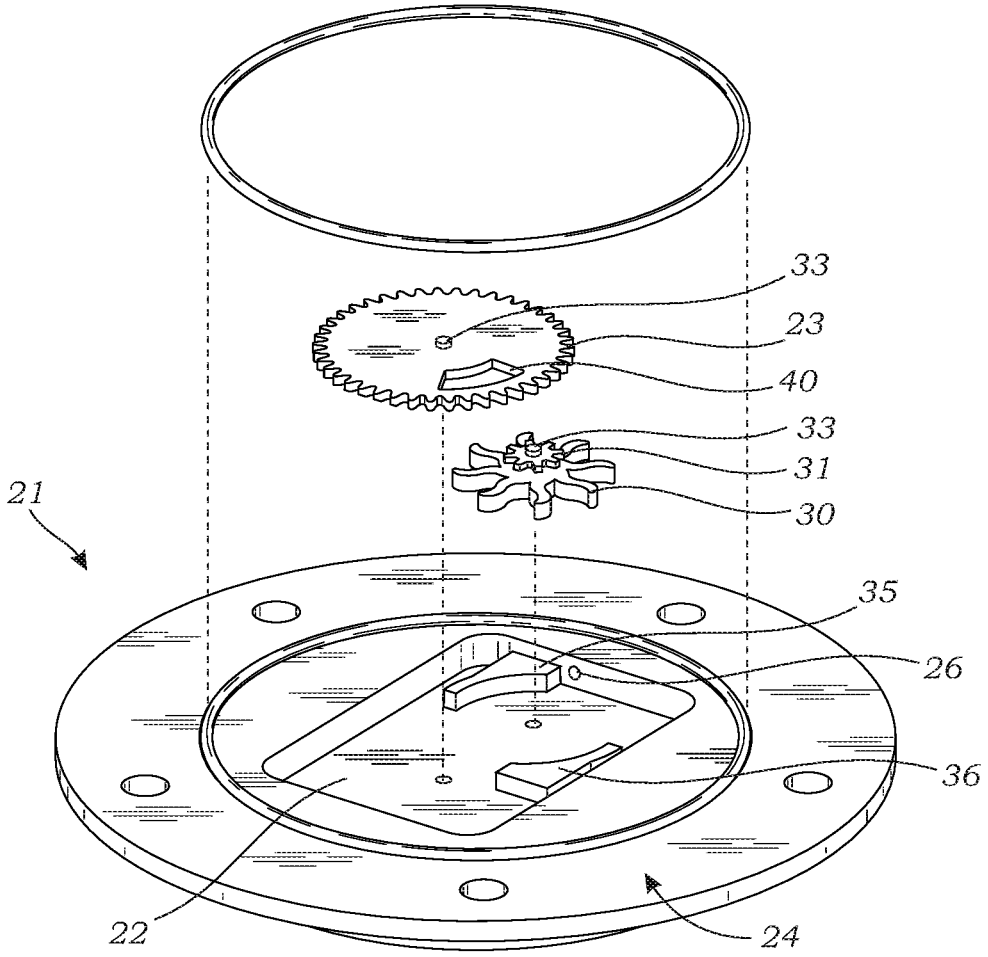
FIG. 7 is a left exploded backside view of the gear housing disk for the showerhead assembly illustrated in FIG. 1, illustrating the arrangement by which the three wheel portions are mounted onto the internal housing structure so as to allow the gear train to rotatably pivot.
Figure 8:
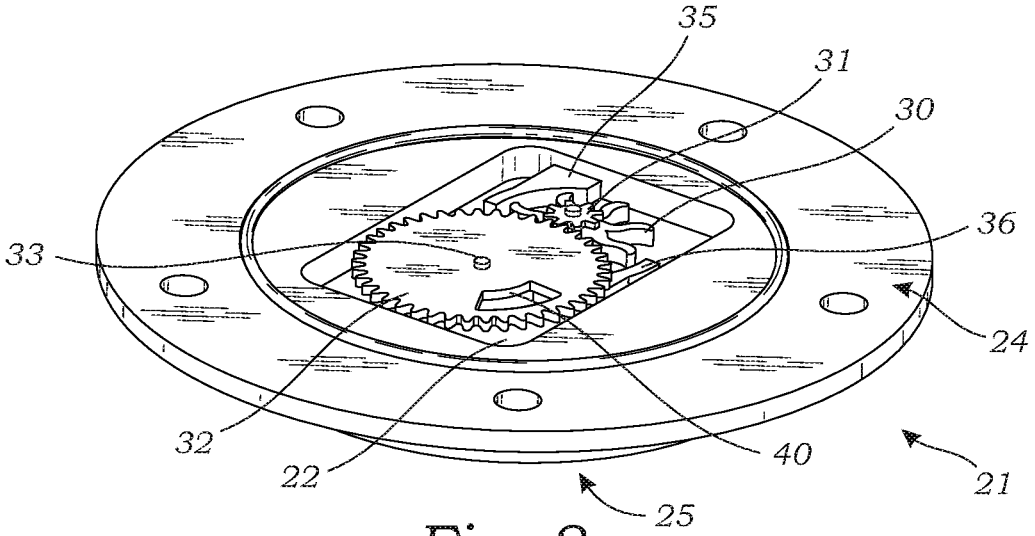
FIG. 8 is a left backside view of the gear housing disk for the showerhead assembly illustrated in FIG. 1, illustrating the layout of the gear train parts on the internal housing structure residing on anterior of the gear housing disk.

While the present invention is susceptible of embodiment in various forms, as shown in the Drawings, hereinafter will be described the presently preferred embodiments of the invention with the understanding that the present disclosure is to be considered as an exemplification of the invention, and it is not intended to limit the invention to the specific embodiments illustrated.

With reference to FIGS. 1-10, the water spraying assembly of the present invention is illustrated as a showerhead assembly 1 which includes an outer housing structure 8 and inner housing structure 9. Preferably, the outer housing structure 8 comprises the showerhead housing base 3 and the showerhead faceplate 2 having four nozzle systems 12A-D. Even more preferably, the inner housing structure 9 includes two primary components: a support disk 20 and a gear housing disk 21. In addition, the inner housing structure 9 further comprises an internal housing structure 22 wherein a gear train 23 resides and works as a unit with a plurality of nozzle systems 12A-D. As would be understood by those skilled in the art, the showerhead assembly may include any number of nozzle systems 12A-D. However, for explanation purposes, a preferred showerhead assembly is described herein as having four nozzle systems 12A-D.

The four nozzle systems 12A-D are incorporated onto the outer housing's circular showerhead faceplate 2 which covers the posterior portion 25 of the inner housing's gear housing disk 21. Even more specifically, the showerhead faceplate's four nozzle systems 12A-D include four ducts 70 formed into the faceplate's back side 72 which extend to the four nozzle outlet sets 71. Preferably, the various nozzle outlet sets 71 emit water in an alternating fashion so as to create a strobe-effect on the spray pattern and provide a more unique shower experience for the user.

Preferably, the showerhead assembly 1 includes a showerhead housing base 3 that is frustoconical in shape. Even more preferably, the showerhead assembly 1 includes a neck portion 4 which houses the conduit 5 and is connected to a water source 6. Further, the conduit 5 includes an inlet 7 threadably affixed to the water source pipe. The inlet 7 receives water from the water source 6 and transports such water to the internal housing structure's water channel 26 so as to convey such water to the nozzle systems 12A-D. The water channel 26 includes a first end 27 and second end 28. Specifically, the first end 27 is in fluid connection with the conduit's inlet 7 and the second end 28 is in fluid connection with the gear train 23, so as to facilitate the passage of water from the conduit 5 through the internal housing structure 22.

In an illustrative embodiment, the inner housing 9 comprises a support disk 20, which forms the inner most layer of the inner housing structure 22, and, which is affixed to and secured onto the gear housing disk 21, thereby functioning as a support structure for the gear housing disk 21. The gear housing disk's posterior side 25 converges with the outer housing of the showerhead faceplate 2.

Additionally, the gear housing disk 21 includes an anterior side 24 and posterior side 25. Moreover, the anterior side 24 includes an internal housing structure 22 having a gear train 23. Preferably, the internal housing structure 22 is cuboid shaped. More preferably, the internal housing structure 22 resides within the depressed nucleus of the gear housing disk's anterior side 24. The gear housing disk's posterior portion 25 is embedded with four sets of similarly shaped window orifices 50A-D. In the preferred embodiment, the four sets of window orifices 50A-D are trapezoidal in shape. In the even more preferred embodiment, the window orifices' 50A-D axes are parallel to or the same as the gear train's 23 axis. Further, each window orifice 50A-D is equidistant from neighboring window orifices 50A-D and reside separately within each of the large gear's four quadrants 60A-D. For example, window orifice 50A is embedded in large gear's quadrant 60A, window orifice 50B is embedded in large gear's quadrant 60B, window orifice 50C is embedded in large gear's quadrant 60C, and window orifice 50D is embedded in large gear's quadrant 60D. The window orifices 50A-D are configured so as to align in a complementary fashion with the four nozzle systems 12A-D embedded on the showerhead faceplate 2. For example, window orifice 50A is configured to align with nozzle system 12A, window orifice 50B is configured to align with nozzle system 12B, window orifice 50C is configured to align with nozzle system 12C, and window orifice 50D is configured to align with nozzle system 12D.

The gear train 23 includes three-wheel portions: a propeller 30, pinion 31, and a slotted large gear 32. Specifically, water flows through the water channel 26 upstream from the gear train 23 and passes through the propeller 30, thereby causing the propeller 30 to rotate in a counterclockwise direction. Even more specifically, the pinion 31 is meshed and oriented above the propeller 30 so as to rotate in a clockwise direction upon counterclockwise rotation of the propeller 30. Additionally, the large gear 32 is sufficiently in contact with the pinion 31 so as to gain momentum by its slight collision with the pinion 31 upon the pinion's 31 rotation. Specifically, the large gear 32 revolves in a clockwise direction as the pinion 31 rotates and water continues to impinge and flow through the entirety of the gear train 23.

In the preferred embodiment, the three-wheel portions are mounted by arbors 33 onto the internal housing structure 22 so as to allow the gear train 23 to rotatably pivot as water passes through the compound gear mechanism. Moreover, the internal housing structure's 22 axis is parallel to or the same as the gear train's 23 axis. Preferably, the propeller's 30 diameter is one half of the large gear's 32 diameter. Even more preferably, the propeller's 30 diameter is one third of the large gear's 32 diameter so as to produce optimal water torque and speed.

As illustrated in FIGS. 5-8, the internal housing structure 22 includes two diverter arms 34 that function as driving forces to propel water through the gear train 23. Accordingly, the diverter arms 34 are in fluid connection with the propeller's 30 teeth and are positioned so as to optimally divert water flow. Specifically, the first diverter arm 35 is erected from the internal housing structure 22 and is directly adjacent to the water channel's second end 28 and to the propeller's 30 left side. Additionally, the second diverter arm 36 is erected from the internal housing structure 22 and resides beneath the large gear 32, bordering the propeller's 30 right side. This methodical configuration allows the diverter arms 34 to appropriately direct and modulate water flow through the internal housing structure 22.

Moreover, the large gear 32 includes one slot 40 configured similarly to the window orifices 50A-D on the gear housing disk's posterior side 25 and resides along the same axis. Preferably, the slot 40 is the same shape and size as the window orifices 50A-D so as to allow the slot 40 to align with one window orifice 50A-D upon rotation of the large gear 32, thereby causing water to travel through the opening and exit the gear housing disk 21. The gear housing disk 21 is parallel and appended to the showerhead faceplate 2 in a manner which allows for water to be received via the nozzle ducts 70 and emit out of the nozzle outlets 71.

Figure 9:
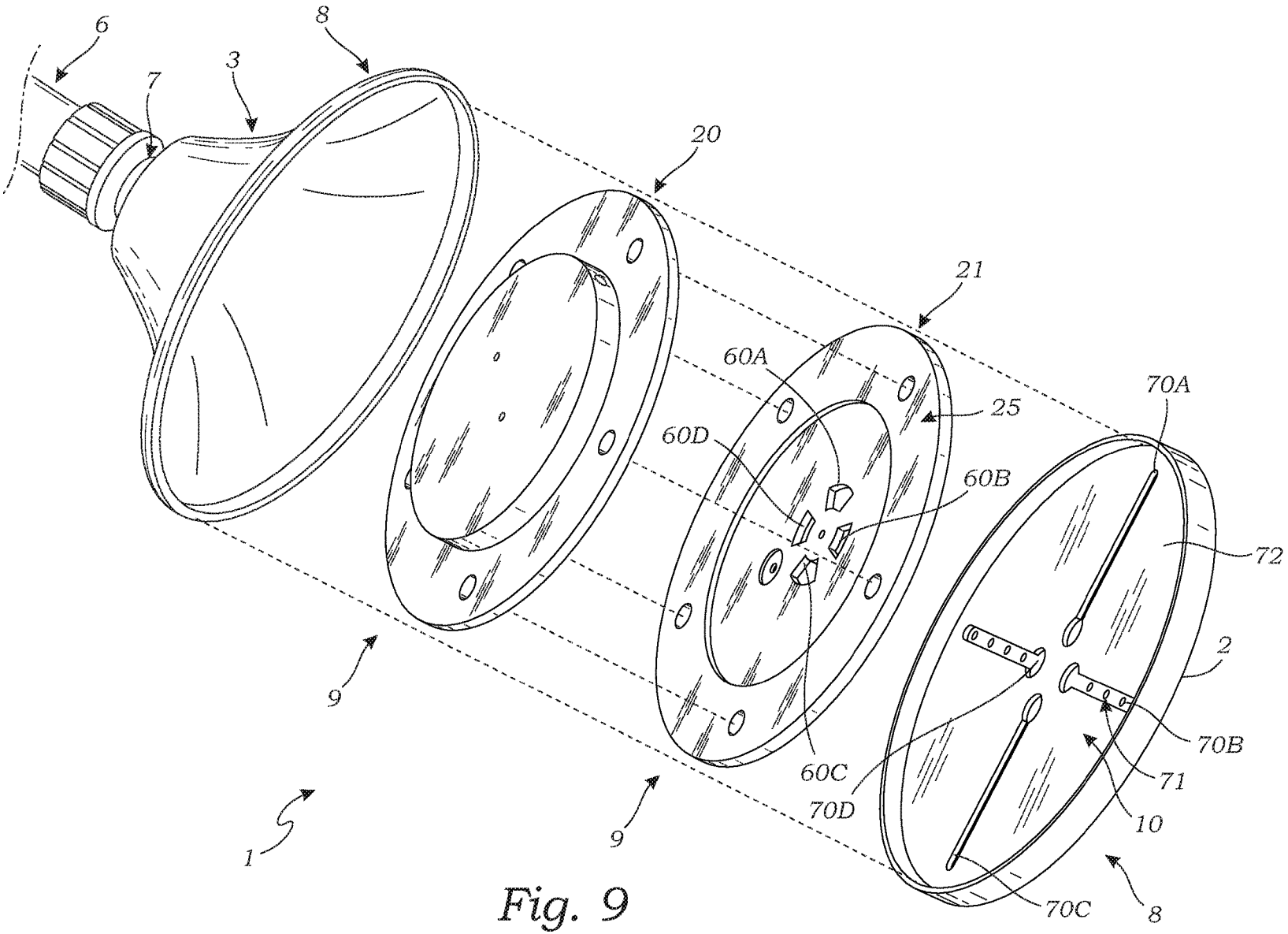
FIG. 9 is a left exploded side view of the showerhead assembly illustrated in in FIG. 1, illustrating the individual outer housing and inner housing components and their respective orientations within the showerhead assembly system.
Figure 10B:
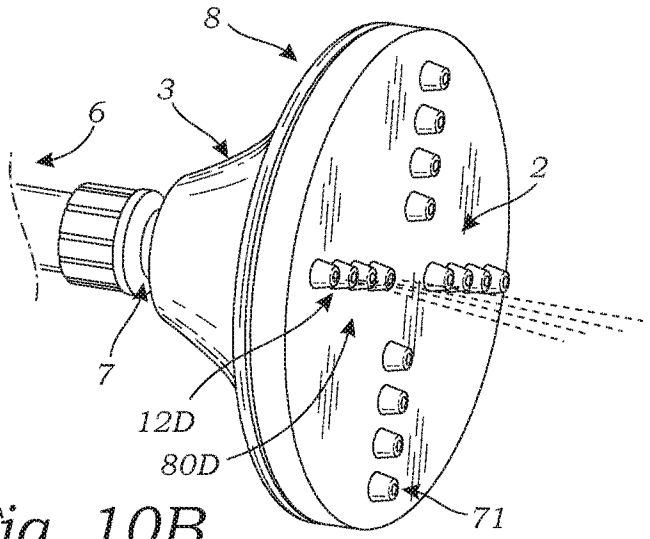
FIG. 10B is a left perspective view of the showerhead assembly illustrated in FIG. 1 wherein the showerhead faceplate's left quadrant nozzle outlet set is projecting water.
Figure 10D:
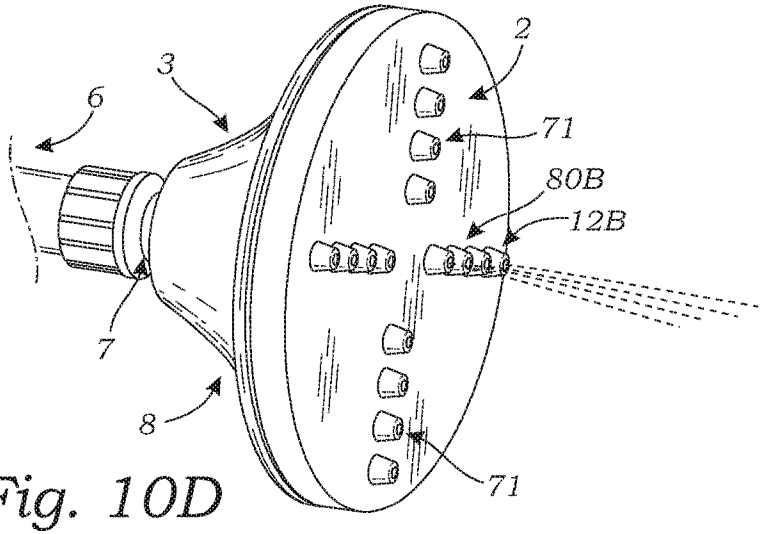
FIG. 10D is a left perspective view of the showerhead assembly illustrated in FIG. 1 wherein the showerhead faceplate's right quadrant nozzle outlet set is projecting water.
Figure 10A:
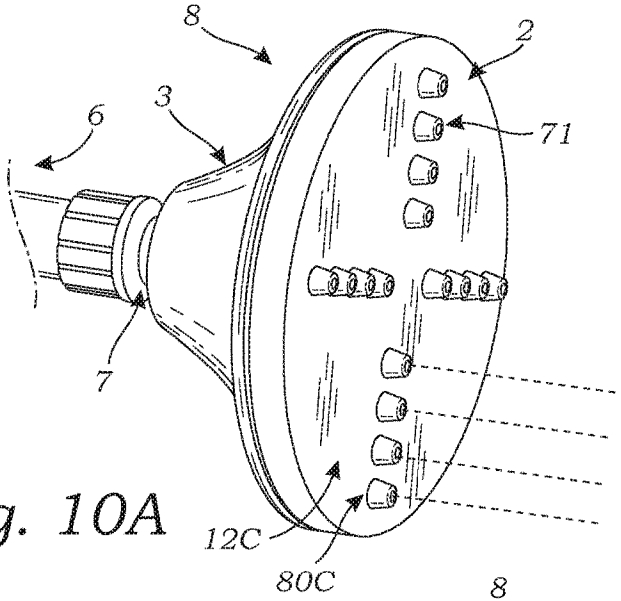
FIG. 10A is a left perspective view of the showerhead assembly illustrated in FIG. 1 wherein the showerhead faceplate's lower quadrant nozzle outlet set is projecting water.
Figure 10C:
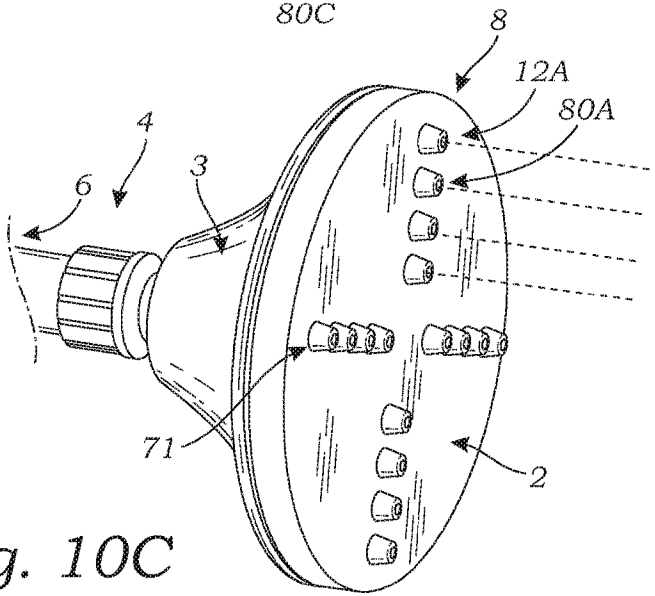
FIG. 10C is a left perspective view of the showerhead assembly illustrated in FIG. 1 wherein the showerhead faceplate's upper quadrant nozzle outlet set is projecting water.

Specifically, the showerhead faceplate 2 comprises four nozzle systems 12A-D. Each nozzle system 12A-D includes a nozzle duct 70 having four nozzle outlets 70. In the preferred embodiment, the four nozzle systems 12A-D are configured in a spatially equidistant manner from neighboring nozzle systems 12A-D. Preferably, and as illustrated in FIGS. 9 and 10, one nozzle system 12A-D resides per each quadrant of the showerhead's faceplate 80A-D. For example, nozzle system 12A resides in showerhead faceplate's quadrant 80A, nozzle system 12B resides in showerhead faceplate's quadrant 80B, nozzle system 12C resides in showerhead faceplate's quadrant 80C, and nozzle system 12D resides in showerhead faceplate's quadrant 80D. Even more preferably, the nozzle ducts 70 are recessed within the showerhead's faceplate 2 while the nozzle outlets 71 project out of the showerhead's faceplate 2. Even more preferably, the nozzle ducts 70 are arranged directly above and adjacent to corresponding window orifices 50A-D on the gear housing disk 21. This configuration allows water received by the window orifice 50A-D to pass through a given nozzle duct 70 and project out of its respective nozzle outlets 71. Notably, the nozzle ducts 70 remain static in position as the gear train 23 revolves in the internal housing structure 22. Water is received by a nozzle system 12A-D only upon alignment of the system's respective nozzle duct 70 with the large gear's slot 40. The gear train 23 functions as a unit with the nozzle systems 12A-D, selectively spraying water in consecutive intervals upon revolution of the large gear 32. Accordingly, each nozzle outlet 70 ejects water successively and rhythmically so as to create a strobe-effect spray pattern for the user.

While a preferred nozzle set and showerhead assembly 1 have been illustrated and described, it would be apparent that various modifications of the nozzle set and showerhead assembly 1 can be made without departing from the spirit and scope of the invention. Accordingly, it is not intended that the invention be limited except by the following claims.

Having described my invention in such terms to enable a person skilled in the art to understand the invention, recreate the invention, and practice it, and having identified the presently preferred embodiments thereof, I claim:

1. A water spraying assembly comprising:

a female threaded inlet to threadably engage a male threaded pipe of a water source;

a longitudinally extending central conduit for the passage of water having a first end, a body, and a second end, said central conduit's first end connected to said female threaded inlet for receiving water, said central conduit's body for conveying such water from said first end to said second end, and said second end forming said central conduit's outlet to expel water;

an outer housing comprising a showerhead housing base and a showerhead faceplate having a front side, a back side and a plurality of nozzle systems, each of said nozzle systems including a duct formed into said faceplate's backside which extend to nozzles which extend through said faceplate to said faceplate's front side;

an inner housing residing within said outer housing, said inner housing comprising an anterior side and posterior side and a gear housing disk having an anterior side and posterior side, said gear housing disk's anterior side includes an internal housing having a water channel, two diverter arms, and a gear train, said gear train includes a propeller, a toothed pinion extending coaxially from said propeller, and a large toothed gear in toothed engagement with said pinion, said large toothed gear having a center about which said large toothed gear rotates and one slot providing a passageway by which water received by said large toothed gear can pass through, said slot offset from said center of said large toothed gear so as to rotate about said center with the rotation of said large toothed gear, and said gear housing's posterior side includes a plurality of orifices with each of said orifices in fluid communication with one of said faceplate ducts, said large toothed gear engaging said gear housing posterior side and obstructing said plurality of orifices so as to prevent water within said inner housing to flow through said plurality of orifices unless said large toothed gear's slot aligns with one of said orifices which allows water within said inner housing to flowing through said slot to a corresponding one of said orifices, and then through a corresponding one of said ducts to be emitted from corresponding nozzles; and said propeller is positioned to rotate as water enters said inner housing to cause said gear train and large toothed gear to rotate to sequentially release water through said nozzles in periodic intervals dependent on a revolution of said large toothed gear.

2. The water spraying assembly of claim 1 wherein said gear housing's posterior side includes four orifices and said faceplate includes four nozzle systems.

* * * * *